US012428930B2

(12) United States Patent
Jain

(10) Patent No.: US 12,428,930 B2
(45) Date of Patent: Sep. 30, 2025

(54) REPAIRING MICRO ANNULUS FOR SELF-HEALING CEMENTS

(71) Applicant: Schlumberger Technology Corporation, Sugar Land, TX (US)

(72) Inventor: Bipin Jain, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/725,241

(22) PCT Filed: May 1, 2023

(86) PCT No.: PCT/US2023/020580

§ 371 (c)(1),
(2) Date: Jun. 28, 2024

(87) PCT Pub. No.: WO2023/215231

PCT Pub. Date: Nov. 9, 2023

(65) Prior Publication Data

US 2025/0109651 A1 Apr. 3, 2025

Related U.S. Application Data

(60) Provisional application No. 63/364,090, filed on May 3, 2022.

(51) Int. Cl.
*E21B 33/138* (2006.01)
*E21B 33/13* (2006.01)
(Continued)

(52) U.S. Cl.
CPC ..... *E21B 33/138* (2013.01); *E21B 33/13* (2013.01); *E21B 47/005* (2020.05); *E21B 47/117* (2020.05)

(58) Field of Classification Search
CPC .... E21B 33/138; E21B 47/005; E21B 47/117; E21B 33/13
See application file for complete search history.

(56) References Cited

U.S. PATENT DOCUMENTS 3,487,038 A 12/1969 Toy
3,558,335 A 1/1971 Messenger
(Continued)

FOREIGN PATENT DOCUMENTS

CN 1320754 C 11/2001
CN 1398945 A 2/2003
(Continued)

OTHER PUBLICATIONS

International Search Report and Written Opinion issued in International Patent application PCT/US2023/020580 on Aug. 24, 2023, 7 pages.
(Continued)

*Primary Examiner* — Tara Schimpf
*Assistant Examiner* — Daniel T Craig
(74) *Attorney, Agent, or Firm* — Jeffrey D. Frantz

(57) ABSTRACT

Described herein are methods of treating cement leaks in a hydrocarbon well. The methods include detecting a leak in a cement structure of the well, in response to detection of the leak, flowing a stimulus fluid containing hydrocarbon species into the well in contact with the cement structure, and monitoring flow of the stimulus fluid to observe closure of a leakage pathway of the cement structure.

20 Claims, 1 Drawing Sheet

(51) Int. Cl.
*E21B 47/005* (2012.01)
*E21B 47/117* (2012.01)

(56) References Cited

U.S. PATENT DOCUMENTS

| | | | | |
|---|---|---|---|---|
| 4,664,816 | A | 5/1987 | Walker | |
| 5,302,200 | A | 4/1994 | Smetana | |
| 5,391,226 | A | 2/1995 | Frankowski | |
| 5,393,343 | A | 2/1995 | Darwin | |
| 5,443,636 | A | 8/1995 | Montgomery | |
| 5,456,751 | A | 10/1995 | Zandi | |
| 5,575,841 | A | 11/1996 | Dry | |
| 5,587,012 | A | 12/1996 | Montgomery | |
| 5,660,624 | A | 8/1997 | Dry | |
| 5,665,158 | A | 9/1997 | Darwin | |
| 5,683,503 | A | 11/1997 | Montgomery | |
| 5,779,787 | A | 7/1998 | Brothers | |
| 5,997,633 | A | 12/1999 | Montgomery | |
| 6,261,360 | B1 | 7/2001 | Dry | |
| 6,296,057 | B2 | 10/2001 | Thiercelin | |
| 6,458,198 | B1 | 10/2002 | Baret | |
| 6,527,849 | B2 | 3/2003 | Dry | |
| 6,645,288 | B1 | 11/2003 | Dargaud | |
| 6,656,263 | B2 | 12/2003 | Audibert | |
| 6,742,592 | B1 | 6/2004 | Le Roy-Delage | |
| 6,843,841 | B2 | 1/2005 | Reddy | |
| 6,902,001 | B2 | 6/2005 | Dargaud et al. | |
| 6,989,334 | B2 | 1/2006 | Miyaki | |
| 7,578,347 | B2 | 8/2009 | Bosma | |
| 7,607,482 | B2 | 10/2009 | Roddy | |
| 7,927,419 | B2 | 4/2011 | Roddy | |
| 8,551,244 | B2 | 10/2013 | Le Roy-Delage et al. | |
| 2003/0181543 | A1 | 9/2003 | Reddy | |
| 2004/0007360 | A1 | 1/2004 | Leroy-Delage | |
| 2004/0163812 | A1 | 8/2004 | Brothers | |
| 2004/0168802 | A1 | 9/2004 | Creel | |
| 2004/0211562 | A1 | 10/2004 | Brothers | |
| 2004/0211564 | A1 | 10/2004 | Brothers | |
| 2004/0221990 | A1 | 11/2004 | Heathman | |
| 2004/0251026 | A1 | 12/2004 | Dargaud | |
| 2005/0120920 | A1 | 6/2005 | Brothers | |
| 2005/0222302 | A1 | 10/2005 | Pageau | |
| 2007/0017676 | A1 | 1/2007 | Reddy | |
| 2007/0137528 | A1 | 6/2007 | Le Roy-Delage et al. | |
| 2008/0099203 | A1 | 5/2008 | Mueller | |
| 2008/0108524 | A1* | 5/2008 | Willberg | C09K 8/035 507/224 |
| 2009/0071650 | A1 | 3/2009 | Roddy | |
| 2009/0088348 | A1 | 4/2009 | Roddy | |
| 2011/0056690 | A1* | 3/2011 | Debruijn | E21B 33/13 166/285 |
| 2011/0120715 | A1 | 5/2011 | Le Roy-Delage | |
| 2011/0146983 | A1 | 6/2011 | Sawdon | |
| 2011/0308788 | A1 | 12/2011 | Ravi | |
| 2012/0205106 | A1* | 8/2012 | Le Roy-Delage | C04B 28/02 166/293 |
| 2013/0062068 | A1* | 3/2013 | Roddy | E21B 47/13 166/310 |
| 2013/0075096 | A1 | 3/2013 | Khalfallah | |
| 2013/0345098 | A1 | 12/2013 | Morris | |
| 2014/0158354 | A1 | 6/2014 | Kumar et al. | |
| 2015/0041134 | A1 | 2/2015 | Carelli | |
| 2016/0031731 | A1 | 2/2016 | Holland | |
| 2018/0215989 | A1 | 8/2018 | Jain | |
| 2018/0230358 | A1 | 8/2018 | Jain | |
| 2021/0363401 | A1 | 11/2021 | Jones | |

FOREIGN PATENT DOCUMENTS

| | | | |
|---|---|---|---|
| EP | 1129047 | A1 | 9/2001 |
| EP | 2457974 | A1 | 5/2012 |
| GB | 2271350 | A | 4/1994 |
| WO | 200020350 | A1 | 4/2000 |
| WO | 200037387 | A1 | 6/2000 |
| WO | 0170646 | A1 | 9/2001 |
| WO | 200174967 | A1 | 10/2001 |
| WO | 03068708 | A1 | 8/2003 |
| WO | 2004111388 | A1 | 12/2004 |

OTHER PUBLICATIONS

Nelson EB, Drochon B, Michaux M and Griffin TJ: "Special Cement Systems," in Nelson EB and Guillot D. (eds.): Well Cementing (2nd Edition), Schlumberger, Houston (2006), pp. 233-268.C2.

Leugemors E, Metson J, Pessin, J-L, Colvard RL, Krauss CD and Plante M: "Cementing Equipment and Casing Hardware," in Nelson EB and Guillot D: Well Cementing—Second Edition, Houston, Schlumberger (2006), pp. 343-434.

Nelson EB, Michaux M and Drochon B: "Cement Additives and Mechanisms of Action," in Nelson EB and Guillot D (eds): Well Cementing-Second Edition, Houston, Schlumberger (2006), pp. 49-91.

Reddy et al., "Self-Healing Cements that Heal Without Dependence on Fluid Contact", SPE International Symposium on Oilfield Chemistry, 2009, SPE 121555, 7 pages.

Carrion et al., "Elastic Self-Sealing Cement and Swellable Packer Tool Provides Competent Zonal Isolation to Withstand the Stress Regimes during the Life of the Well: Ecuador Case History", SPE Western Venezuela Section South American Oil and Gas Congress, Society of Petroleum Engineers, SPE 163084, 2011, 11 pages.

International Search Report and Written Opinion issued in International Patent Appl. No. PCT/MY2015/000063 on Nov. 26, 2015; 10 pages.

International Search Report and Written Opinion issued in International Patent Appl. No. PCT/MY2015/000062 on May 13, 2016; 10 pages.

Office Action issued in the related RU application 2018107690, dated Mar. 4, 2019 (18 pages).

Office Action issued in the related RU application 2018107688, dated Mar. 4, 2019 (17 pages).

"Three designs for the internal release of sealants, adhesives, and waterproofing chemicals into concrete to reduce permeability," C.M. Dry, Cement and Concrete Research 30 (2000) 1969-1977.

* cited by examiner

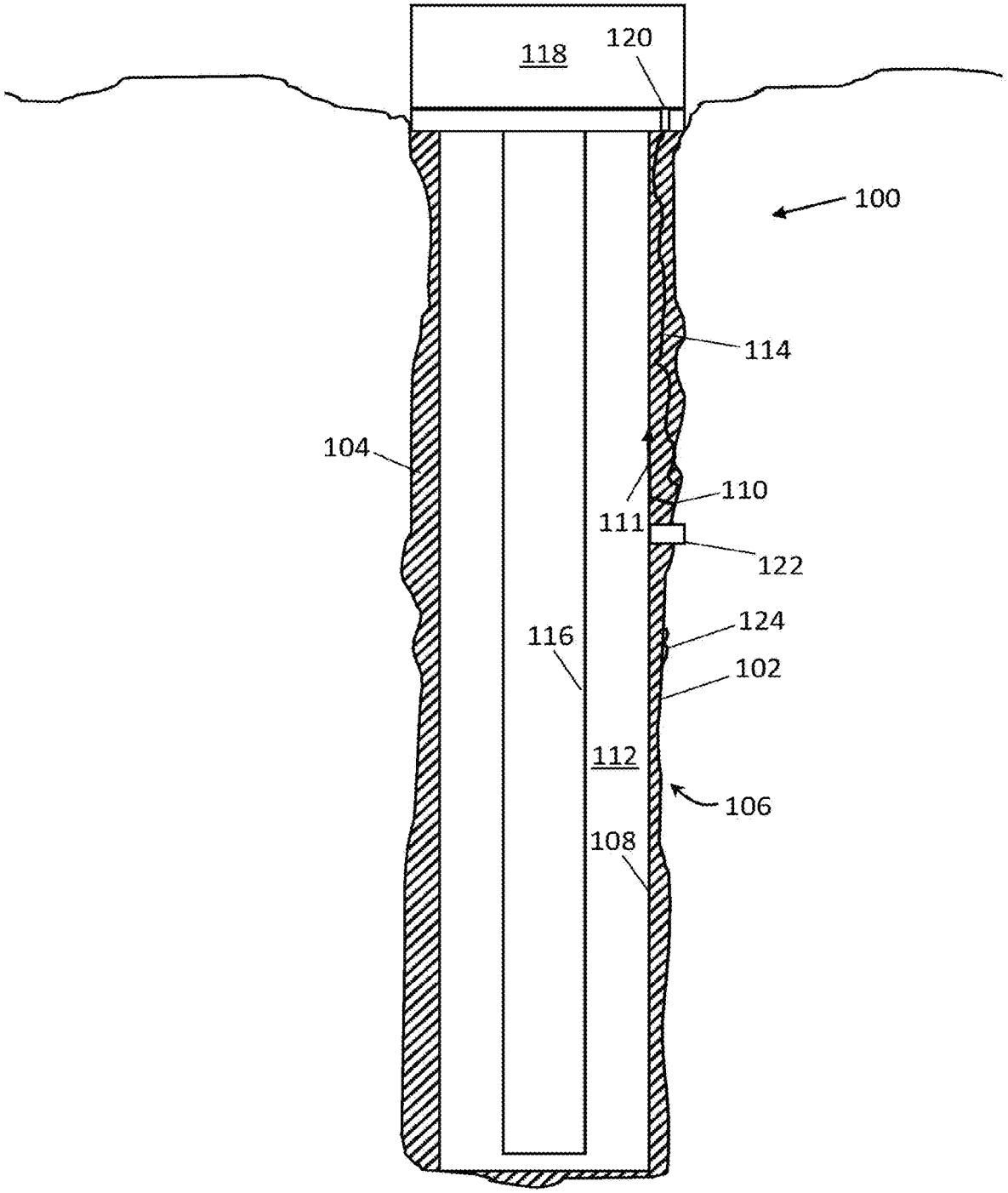
118
120
100
114
104
110
111
122
124
116
102
112
106
108

REPAIRING MICRO ANNULUS FOR SELF-HEALING CEMENTS

CROSS REFERENCE PARAGRAPH

This application is a National Stage Entry of International Application No. PCT/US2023/020580, filed May 1, 2023, which claims benefit of U.S. Provisional Patent Application Ser. No. 63/364,090, filed May 3, 2022, which are entirely incorporated herein by reference.

BACKGROUND

This patent application addresses methods and compositions for well casings. Specifically, this patent application addresses methods and compositions for repairing well casing leaks.

DESCRIPTION OF THE RELATED ART

Hydrocarbons are commonly recovered from subterranean reservoirs by drilling a well into the reservoir, or a geologic formation associated with the reservoir. The well is a hole in the ground. To turn the well into a pathway for flowing hydrocarbons from the reservoir to the earth's surface, the well is typically cased. A pipe having diameter somewhat less than the well diameter is inserted into the well to define an annular space around the pipe between the pipe and the well wall. The pipe typically extends to near the bottom of the well and may rest on the bottom of the well.

Cement is pumped down the pipe to the bottom of the well and then forced to flow upward in the annular space around the outside of the pipe to the surface or to an end point. The cement may be pushed down the pipe and up into the annulus using a mud mixture or other fluid that clears the cement from the pipe and provides a pad support for the annular cement casing. The cement is hardened to form a sheath around the pipe. After the cement has hardened, the fluid mixture used to flow the wet cement can be removed from the well. The well may be idled until production is started by installing a cement plug inside the pipe.

The casing and sheath are designed to seal the well wall to prevent uncontrolled fluid flows to and from the subterranean formation. By sealing the well wall, production flows from the well can be selected and controlled to optimize recovery of hydrocarbons while otherwise minimizing disturbance of the subterranean environment and minimizing flows of unwanted fluids to the surface.

Typically, a cement is used that reacts with hydrocarbon to increase in volume. The wet cement is a mixture of water, cement, and particles that swell on contact with hydrocarbon. Occasionally, the cement sheath leaks due to debonding of the cement sheath from the casing or the well wall, which forms a micro annulus leakage pathway, or due to damage to the cement sheath itself. Fluids may flow between the cement sheath and the well wall toward the surface, through the cement sheath to the casing, between the casing and the sheath toward the surface, and even through the casing itself. Conventional cements tend to shrink once they harden creating a micro annulus or a flow path through which fluids can flow. Some cements used to sheath the casing are termed "self-healing" because contact with hydrocarbon fluids from the reservoir or from the oil based mud that is used for drilling causes swellable components of the cement to swell and close the leak pathways. When contacted by hydrocarbon from the reservoir, the surface of the cement sheath adjacent to the well wall can swell outward to tighten the seal against the well wall, or the surface of the cement sheath adjacent to the casing can swell inward to tighten the seal against the casing. The cement of the sheath can also swell to seal any passages through the cement.

Cement is also used to idle a well or for permanent abandonment by installing a cement plug in the well. Cement plugs are also found to leak on occasion. Fluid is sometimes observed collecting above the plug, and gas may be observed to escape through the plug in some cases.

Not all cement leaks are caused by or in contact with hydrocarbon. A cement leak may involve only groundwater or gas, for example. While hydrocarbon gas reacts with hydrocarbon-susceptible materials in cement, the small size of hydrocarbon gas molecules results in little or no swelling. In some cases, the leak can be caused by a larger crack or opening that can exhaust the innate capacity of the cement to swell, even in the presence of hydrocarbon. In such cases, leak remediation is needed for cement leaks in a cased and cemented well.

SUMMARY

Embodiments described herein provide a method of treating a well having a hardened cement structure, the method comprising detecting a leak in the cement structure; in response to detection of the leak, flowing a stimulus fluid containing hydrocarbon species into the well in contact with the cement structure; and monitoring flow of the stimulus fluid to observe closure of a leakage pathway of the cement structure.

Other embodiments described herein provide a method of treating a well having a hardened self-healing cement structure, the method comprising detecting a leak in the self-healing cement structure; in response to detection of the leak, flowing a stimulus fluid containing hydrocarbon species into the well in contact with swellable components of the cement structure; and monitoring flow of the stimulus fluid to observe closure of a leakage pathway of the cement structure.

BRIEF DESCRIPTION OF THE DRAWINGS

FIG. 1 is an activity diagram showing a well formed for hydrocarbon production and activities that can be performed on the well according to embodiments described herein.

DETAILED DESCRIPTION

Where cement leaks are not naturally remediated by exposure to hydrocarbon in the ground, cement leaks can be addressed in a cemented and cased well by stimulating the hardened cement to swell and seal any leakage pathways. A stimulus fluid can be pumped into the well to expose the leak zone to fluid that will cause swelling of swellable components of the cement.

A swellable cement is a mixture of water, cement, swellable components, and optionally additives. The cement can be Portland cement, calcium aluminate cement, lime-silica blends, geopolymers, Sorel cements, chemically bonded phosphate ceramics, zeolite, and cement-kiln dust, or any mixture thereof, optionally with extenders such as fly ask, blast-furnace slag, silica, silica fume, nanosilica, and nanoalumina. The swellable components can be particles of ground rubber, polypropylene, uintaite, poly-2,2,1-bicyclo heptene (polynorbornene), alkylstyrene, crosslinked substituted vinyl acrylate copolymers, polyisoprene, polyvinyl acetate, polychloroprene, acrylonitrile butadiene, hydrogenated acrylonitrile butadiene, ethylene propylene diene monomer, ethylene propylene monomer, styrene-butadiene, styrene/propylene/diene monomer, brominated poly (isobutylene-co-4-methylstyrene), chlorosulphonated polyethylenes, polyacrylates, polyurethanes, silicones, chlorinated polyethylene, epichlorohydrin ethylene oxide copolymer, ethylene acrylate rubber, ethylene propylene diene terpolymers, sulphonated polyethylene, fluorosilicones, fluoroelastomer, substituted styrene acrylate copolymers and mixtures thereof. Or, the swellable particulate material may comprise ground rubber, polypropylene or uintaite or combinations thereof. Uintaite is a naturally occurring solid hydrocarbon material, a form of asphalt or bitumen, with a relatively high melting temperature. Uintaite is also called Gilsonite. Additional particle/solvent combinations may be selected by consulting the following publication: *Chemical Resistance of Plastics and Elastomers* (4th Electronic Edition), William Andrew Publishing/Plastics Design Library, Norwich, New York (2008). These materials are all susceptible to hydrocarbon molecules or hydrocarbon species, for example portions of molecules that have hydrocarbon structure, and can swell by absorbing such species.

The cement may include geopolymers. Geopolymers use an aluminosilicate source and an alkali activator in an aqueous solution having high pH to form a polymer. Examples of aluminosilicate sources that can be used include (but are not limited to) ASTM type C fly ash, ASTM type F fly ash, fly ash not classified by ASTM, volcanic ash, ground blast furnace slag, calcined clays, which may be partially or fully calcined clays (metakaolin is a partially calcined clay), aluminum-containing silica fume, natural aluminosilicate, synthetic aluminosilicate glass powder, zeolite, scoria, allophone, bentonite, red mud, which may be calcined, and pumice. These materials contain a significant proportion of an amorphous aluminosilicate phase, which reacts in strong alkaline solutions. The more common aluminosilicates are fly ash, metakaolin and blast furnace slag. Mixtures of two or more aluminosilicate sources may also be used if desired. In addition, alumina and silica may be added separately, for example as a blend of bauxite and silica fume.

Formation of a set geopolymer also involves an alkali activator. The alkali activator may be an alkali metal, an alkaline-earth metal hydroxide, or combinations thereof. Alkali metal hydroxides may be sodium, lithium, or potassium hydroxide. Alkaline-earth metal hydroxides may include calcium, barium, or magnesium hydroxide. Mixtures of alkali metal hydroxides, alkaline earth metal hydroxides, and mixtures of both alkali metal and alkaline earth metal hydroxides can be used. The metal hydroxide may be in the form of a solid or an aqueous mixture. Also, the activator in another embodiment can be encapsulated. The activator when in solid and/or liquid state can be trapped in a capsule that will break when subjected to, for example, mechanical stress on the capsule, or coating degradation owing to temperature, chemical exposure or radiation exposure. Also, the activator when in solid and/or liquid state can be trapped in a capsule that will naturally degrade if made from a biodegradable or self-destructive material. Furthermore, the alkali activator when in liquid state may be adsorbed into a porous material and may be released after a certain time or due to a predefined event. The alkali activator may be present in the composition at a concentration between about 0.1 moles/L (M) to 10M or between 3M and 6M.

Usable additives can include retarders, accelerators, extenders, fluid-loss-control additives, lost-circulation additives, gas-migration additives, gas generating additives, anti-foam agents, and strengthening agents. Examples of strengthening agents include polyethylene, acrylonitrile, butadiene, styrene butadiene, polyamide, polytetrafluoroethylene, polyether ether ketone, perfluoroalkoxy polymer resin, fluorinated ethylenepropylene, polyethylenetetrafluoroethylene, polyvinylfluoride, polychlorotrifluororethylene, perfluoroelastomers, fluorocarbon elastomers and combinations thereof. Fibers and metallic microribbons can also be included in the cement.

FIG. 1 is an activity diagram schematically showing a well 100 formed for hydrocarbon production and activities that can be performed on the well according to embodiments described herein. The well wall 102 is sealed by a cement sheath 104 formed in the annular space 106 between the well wall 102 and a casing 108 installed in the well. FIG. 1 shows two leak pathways in the cement sheath 104. A first leak pathway 110 is from the well wall 102 to the casing 108, and may penetrate the casing 108 to an interior 112 of the casing 108. Material flowing through the first leak pathway 110 can flow up the interior or exterior surface of the casing 108 toward the surface, as shown by arrow 111. A second leak pathway 114 is from the well wall 102 through the cement sheath 104 vertically to the surface. The well is shown with a tubular structure 116 installed for performing various testing and/or production functions, and a surface facility 118 to control flows materials into and out of the well and to monitor operations. The surface facility 118 typically includes a fluid pathway to an interior of the tubular structure 116 as well as a port 120 to provide a fluid pathway to the annular space 106 of the cement sheath 104. The well 100 may have one or more perforations 122 formed through the casing 108 and the cement sheath 104 into the subterranean formation to facilitate extraction of fluids from the formation. A third leak pathway 124 is shown along the interface between the cement sheath 104 and the well wall 102, where the cement sheath 104 has debonded from the well wall 102. The third leak pathway 124 can allow fluids from one sub surface layer can leak into another sub surface layer, leading to increased water production if a water zone leaks into an oil zone, loss of hydrocarbon from a producing layer to another layer, or contamination of a fresh water zone.

The cement sheath generally forms an interface with the well wall and with the outer surface of the casing. The slurry from which the cement is formed typically contains some oleaginous material to cause hydrocarbon susceptible components of the cement to swell upon hardening to form a pressurized interface with the well wall and with the outer surface of the casing. Cracks can form in the cement due to temperature fluctuations, ground movements, action of fluids, or other causes. In general, leaks in the casing sheath can manifest as surface appearance of subterranean fluids and/or persistent pressure inside the well casing. The leaks can arise from pathways at the interface between the sheath and the well wall, pathways at the interface between the sheath and the casing, pathways through the sheath, and pathways through the casing.

In response to detection of leaks in the casing sheath, a stimulus fluid can be pumped into the well, either into the annulus outside the casing or into the interior of the casing, or both. The stimulus fluid is, or contains, a water-immiscible fluid that stimulates non-saturated swellable components of the cement to swell and seal leakage pathways. The stimulus fluid can be a hydrocarbon material or a material comprising hydrocarbons or molecules with hydrocarbon characteristics to stimulate swelling of the swellable components of the cement. The stimulus fluid can be a pure fluid or a mixture that contains hydrocarbons or molecules with hydrocarbon characteristics. Examples of materials that can be included in a stimulus fluid include crude oil, mineral oil (any of groups 1 to 3), diesel oil, lubricating oils, vegetable oil, linear alpha-olefins, xylene, toluene, or a combination thereof. These oils can be mixed with waxes in some cases, where the wax content is not enough to fall out of solution or make the oil unpumpable. Lighter hydrocarbons can also be included, but volatility (vapor pressure) of the fluid is typically minimized for field use.

In a first method, a cement leak is detected in a well by emergence of fluid and/or gas at the earth's surface from outside the casing. In response to observation of the fluid emerging from the annulus between the casing and the well wall, a fluid containing long-chain hydrocarbon species (which may be molecules or portions of molecules) is pumped into the annulus using standard wellhead fixtures such as the port 120. Flow of fluid into the annulus is monitored, and pumping is continued while flow is observed. Once the stimulus fluid pumping is complete, the annulus can be blocked in by closing a valve of the surface facility 118 to allow pressure to remain in the annular space 106 and to provide time for self-healing to take place. Pressure promotes intrusion of long-chain hydrocarbon structures into the swellable components of the cement to cause swelling in non-saturated components. If components of the cement exposed along the leakage pathway retain some swelling capacity, absorbable species, generally linear species with hydrocarbon structure (molecules and portions of molecules) will be absorbed by the hydrocarbon susceptible components of the cement, which will grow in volume. If the leakage pathway is small in dimension, the swelling may be enough to close the pathway altogether, stopping the leak.

In some cases, exposure to hydrocarbon-containing fluids or fluids containing hydrocarbon structures (such as vegetable oils) may not stimulate enough swelling of swellable components of the cement to close the leakage pathway. This can be due to any combination of a pathway that is too large or swellable components with insufficient remaining swelling capacity. In such cases, leak closure can be enhanced by including swellable bodies in the fluid pumped into the annular space 106. The swellable bodies can be any component from the list of hydrocarbon susceptible materials above. The swellable bodies, for this use, are sized to penetrate at least some portion of the leakage pathway, which in some cases can have micron-scale dimensions. Materials can be selected from the list above that can be reduced to micron-scale particle sizes, if necessary. The swellable bodies are dispersed within the fluid at a concentration that does not strongly reduce pumpability of the fluid. For example, depending on the particular materials used, the swellable bodies may be included in the mixture up to a concentration of about 20 wt %.

Where a stimulus fluid containing swellable bodies is used, the stimulus fluid containing swellable bodies is pumped into the annular space 106, as above, and flow is monitored. The fluid stimulates swelling in any components of the cement that contact the fluid and have capacity to absorb the fluid. Additionally, the swellable bodies in the fluid also absorb the fluid and swell while flowing down the leakage pathway to lodge at a location where the swellable body is unable to pass further. The combination of swellable body deposition and swelling of swellable components of the cement may address leakage that cannot be addressed by pumping stimulus fluid alone into the annular space 106.

In a second method, a cement leak is detected by sustained casing pressure without emergence of fluid or gas at the earth's surface or by fluids moving from one zone to another zone down hole. In such cases, the cement leak is likely down hole with no leakage pathway to the surface to use for pumping a swelling stimulus fluid. In response to detection of sustained casing pressure or loss of zone isolation, downhole facilities can be used to apply a stimulus fluid. If casing pressure is monitored along the length of the well, a stimulus fluid can be applied into the annular space 106 outside the casing 108 at a zone adjacent to a change in casing pressure indicating a cement leak using perforations, such as the perforation 122, previously formed in the casing 108. Alternately, new perforations can be made and isolation applied, if desired, to target application of a stimulus fluid. If casing pressure is not known along the length of the well, but is for example only known at the earth's surface, the well can be systematically treated with stimulus fluid through all existing ports.

As above, during downhole treatment flow of stimulus fluid is monitored. If location of ports is known, volume to the port can be calculated. If flow into the well continues after the stimulus fluid reaches the selected port, and if that port is isolated from downhole volumes, it can be surmised that the stimulus fluid is flowing into the annulus. The flow can be monitored until flow stops, indicating the stimulus fluid has reached a barrier in the annulus. The fluid can then be blocked in under pressure by closing a valve at the surface to allow time for penetration of the fluid into swellable components of the cement. Also, as above, where a large leakage pathway is suspected, or low capacity for additional swelling of cement components is suspected, swellable bodies can be added to the stimulus fluid, as above.

In either the first method or the second method, closure of the leak can be verified by repeating flow of the fluid into the affected area. If less fluid flows before stoppage, it can be surmised that the leakage pathway has been reduced or eliminated. If there is verifiable flow into the annulus during the second treatment, the flow can be blocked in under pressure by closing surface valves, as above, to allow additional time for more swelling of the cement to occur. Treatment can be repeated as many times as desired to accomplish sufficient closure of the leakage pathway and to verify that the leakage pathway is closed.

In some cases, wells are idled or permanently abandoned by installing a cement plug in the well. These cement plugs can also form leaks over time. Such leaks can be detected by emergence and/or re-emergence of fluids above the plug or by changing pressure above the plug, between the plug and the surface of the earth.

In a third method, a plug leak is detected in a cement plug installed in a well. The plug leak is detected by a change in pressure on surface or sub surface or by flow of fluid at the plug that can lead to leakage at the surface. A plug leak can also be diagnosed by applying pressure above the plug to perform a pressure test. If a self-healing cement comprising swellable components was used to form the plug, a stimulus fluid can be applied to the top of the plug to stimulate swelling of swellable components of the cement with remaining swelling capacity. If such capacity remains, the stimulus fluid will be absorbed by the swellable components and the top of the plug will swell outward to tighten the seal between the plug and the surrounding tubular structure.

If cement was used that does not have self-healing characteristics, the stimulus fluid can be provided with swellable bodies before application to the cement plug. As above, the swellable bodies can be added to the fluid in a way tailored to penetrate any leakage pathways of the cement plug, at least to an extent to close the leakage pathway upon deposition of the swellable body. A stimulus fluid containing swellable bodies can also be used to close a leakage pathway in a cement sheath formed without swellable components, using conventional cement. The stimulus fluid containing swellable bodies is pumped down the well, through the tubular structure or annular space, to deposit particles swelled by exposure to hydrocarbon fluid in the leakage pathway.

In some cases, stimulus fluid may be pumped downhole using the tubular structure 116, and concurrently, using the port 120 to flow stimulus fluid into the annular space 106. Multiple leak pathways can be treated concurrently by such dual-flow measures. Additionally, leak pathways can be closed by pumping stimulus fluid down the leak pathway from above in the annular space 106 and by pumping stimulus fluid from below using the tubular structure 116 and a perforation such as the perforation 122.

While the foregoing is directed to embodiments of the present invention, other and further embodiments of the present disclosure may be devised without departing from the basic scope thereof, and the scope thereof is determined by the claims that follow.

What is claimed is:

1. A method of treating a well having a hardened cement structure, the method comprising:

detecting a leakage pathway in the hardened cement structure, the leakage pathway penetrating from a well wall of the well into the hardened cement structure and extending to a surface of the well through the hardened cement structure and within an annular region between a casing of the well and the well wall;

in response to detecting the leakage pathway, flowing a stimulus fluid through the leakage pathway in the hardened cement structure, wherein the flowing includes, at the surface of the well, flowing the stimulus fluid through the annular region between the casing of the well and the well wall, the stimulus fluid containing hydrocarbon species; and monitoring flow of the stimulus fluid to observe closure of the leakage pathway of the hardened cement structure.

2. The method of claim 1, wherein the hardened cement structure is a casing sheath and the hardened cement structure contains hydrocarbon susceptible components that swell upon absorbing hydrocarbon species.

3. The method of claim 1, wherein the stimulus fluid is water-immiscible.

4. The method of claim 1, wherein the stimulus fluid contains swellable bodies susceptible to hydrocarbon species.

5. The method of claim 4, further comprising:

while flowing the stimulus fluid through the leakage pathway, absorbing the hydrocarbon species in the stimulus fluid with the swellable bodies, resulting in at least partially swelled swellable bodies; and depositing the at least partially swelled swellable bodies within the leakage pathway based on the at least partially swelled swellable bodies becoming lodged at a location in the leakage pathway where the at least partially swelled swellable bodies are unable to pass further.

6. The method of claim 4, wherein the swellable bodies are micron-scale.

7. The method of claim 1, further comprising, simultaneously with flowing the stimulus fluid into the leakage pathway in the annular region at the surface of the well, flowing the stimulus fluid from the surface of the well into an interior of a tubular structure disposed within the well, from the tubular structure to a port formed through the casing, and from the port to the well wall between the well wall and the hardened cement structure.

8. The method of claim 7, further comprising forming the port by perforating the casing and the hardened cement structure.

9. A method of treating a well having a hardened self-healing cement structure, the method comprising:

detecting a leakage pathway in the hardened self-healing cement structure, the leakage pathway penetrating from a well wall of the well into the hardened self-healing cement structure and extending to a surface of the well through the hardened self-healing cement structure and within an annular region between a casing of the well and the well wall, wherein the hardened self-healing cement structure includes first swellable bodies positioned therein susceptible to hydrocarbon species;

in response to detecting the leakage pathway, flowing a stimulus fluid through the leakage pathway in the hardened self-healing cement structure, wherein the flowing includes, at the surface of the well, flowing the stimulus fluid through the annular region between the casing of the well and the well wall, the stimulus fluid containing hydrocarbon species and containing second swellable bodies susceptible to the hydrocarbon species;

closing the leakage pathway, including a combination of:

causing the first swellable bodies to swell based on contacting the first swellable bodies of the hardened self-healing cement structure with the stimulus fluid and based on the first swellable bodies absorbing the hydrocarbon species of the stimulus fluid; and causing the second swellable bodies to swell based on the second swellable bodies absorbing the hydrocarbon species of the stimulus fluid; and monitoring flow of the stimulus fluid to observe closure of the leakage pathway of the hardened self-healing cement structure.

10. The method of claim 9, wherein the hardened self-healing cement structure is a casing sheath in the annular region between the casing and the well wall.

11. The method of claim 9, further comprising pressurizing the annular region for a time period such that the first swellable bodies and the second swellable bodies absorb the hydrocarbon species of the stimulus fluid over the time period.

12. The method of claim 11, wherein blocking in the leakage pathway includes closing a valve at the surface of the well to seal the annular region and to build up pressure in the annular region.

13. The method of claim 9, wherein the hydrocarbon species includes long-chain hydrocarbon structures, and wherein the first swellable bodies and the second swellable bodies swell by the long-chain hydrocarbon structures intruding into the first swellable bodies and the second swellable bodies.

14. The method of claim 9, further comprising flowing the stimulus fluid through the leakage pathway through a port at the surface of the well in the annular region.

15. The method of claim 9, wherein the swelling of the first swellable bodies partially closes the leakage pathway based on the leakage pathway being too large for the hardened self-healing cement structure to close with the first swellable bodies.

16. The method of claim 9, wherein the swelling of the first swellable bodies partially closes the leakage pathway based on the first swellable bodies being at least partially swelled prior to flowing the stimulus fluid and further based on a remaining swelling capacity of the first swellable bodies being insufficient to close the leakage pathway.

17. The method of claim 9, further comprising:

while flowing the stimulus fluid through the leakage pathway, absorbing the hydrocarbon species in the stimulus fluid with the swellable bodies, resulting in at least partially swelled swellable bodies; and depositing the at least partially swelled swellable bodies within the leakage pathway based on the at least partially swelled swellable bodies becoming lodged at a location in the leakage pathway where the at least partially swelled swellable bodies are unable to pass further.

18. The method of claim 9, wherein flowing the stimulus fluid includes pumping the stimulus fluid at the surface through the leakage pathway within the annular region.

19. The method of claim 9, wherein the stimulus fluid includes the second swellable bodies at a concentration of 20 wt % or less.

20. The method of claim 9, further comprising detecting the leakage pathway by detecting an emergence of subterranean fluid at the surface of the well within the annular region and from outside of the casing.

* * * * *